US005647773A

United States Patent [19]

Yamaguchi et al.

[11] Patent Number: 5,647,773

[45] Date of Patent: Jul. 15, 1997

[54] CONNECTOR FOR CONNECTING TERMINALS TO CIRCUIT BOARD

[75] Inventors: Noboru Yamaguchi; Masaya Yamamoto, both of Shizuoka-ken, Japan

[73] Assignee: Yazaki Corporation, Tokyo, Japan

[21] Appl. No.: 512,932

[22] Filed: Aug. 9, 1995

[30] Foreign Application Priority Data

Aug. 10, 1994 [JP] Japan ..... 6-188133
Jul. 6, 1995 [JP] Japan ..... 7-170800

[51] Int. Cl.[6] ..... H01R 13/514

[52] U.S. Cl. ..... 439/752; 439/140

[58] Field of Search ..... 439/140, 752, 439/595

[56] References Cited

U.S. PATENT DOCUMENTS

| | | | |
|---|---|---|---|
| 5,051,100 | 9/1991 | Kato et al. | 439/140 |
| 5,232,373 | 8/1993 | Sawada | 439/140 |
| 5,454,740 | 10/1995 | Sakano et al. | 439/752 |
| 5,516,308 | 5/1996 | Yamanashi | 439/752 |

FOREIGN PATENT DOCUMENTS 5-36778 5/1993 Japan .

*Primary Examiner*—Neil Abrams
*Assistant Examiner*—Eugene Byrd
*Attorney, Agent, or Firm*—Finnegan, Henderson, Farabow, Garrett & Dunner, L.L.P.

[57] ABSTRACT

A connector for connecting a plurality of metal terminals (25) to a circuit board (95) includes a connector housing (27) formed with a plurality of metal terminal accommodate chambers (39), a terminal cover (31) engaged with both ends of the connector housing slidably between a terminal cover position and a terminal uncover position, and a terminal retainer (33, 96, 107) engaged with the connector housing between a temporal engage position and a full engage position; the metal retainer includes a plurality of flexible detect arms (87, 101, 103), and a plurality of detect projections (89, 103, 115) being not inserted into each of the terminal accommodate chambers due to contact with the imperfectly-inserted metal terminal at the full engage position, but inserted into each of the terminal accommodate chambers at the temporal engage position without contact with the perfectly-inserted metal terminal.

9 Claims, 8 Drawing Sheets

CONNECTOR FOR CONNECTING TERMINALS TO CIRCUIT BOARD

BACKGROUND OF THE INVENTION

1. Technical Field

The present invention relates to a connector for connecting a plurality of metal terminals each clamped to wire to each of a plurality of terminal plates formed on a printed circuit board, and more particularly to a connector of this sort provided with a metal terminal cover and a terminal retainer.

2. Description of the Related Art

An example of a connector for connecting a plurality of metal terminals each clamped to wire to a printed circuit board is disclosed in Japanese Published Unexamined (Kokai) Utility Model Application No. 5-36778. The connector of this sort is usually composed of a connector housing for housing a plurality of metal terminals clamped to wire, respectively; a terminal retainer for retaining the inserted metal terminals inserted into the connector housing; and a terminal cover moved from a terminal cover position to a terminal uncover position only when the metal terminals have been all inserted perfectly into the connector housing and thereby the terminal retainer can be engaged with the connector housing at the full engage position. On the other hand, the printed circuit board can be inserted into a connector engage opening of the casing for connection with the metal terminals, only when the terminal cover can be moved from the terminal cover position and to the terminal uncover position.

For the connector of this type, a mechanism for detecting that the metal terminals have been all inserted perfectly into the connector housing is provided by utilization of the mutual positional relationship between the terminal retainer and the terminal cover, as described above.

In more detail, only when all the metal terminals have been inserted into the connector housing perfectly in the horizontal direction, for instance, the terminal retainer can be perfectly engaged with the metal terminals within the connector housing in the vertical direction, so that the terminal cover can be moved from the terminal cover position to the terminal uncover position in the horizontal direction without any interference with the terminal retainer. In other words, even if any one of the metal terminal is not perfectly inserted into the connector housing, since the terminal retainer is disengaged from the metal terminal, the terminal retainer interferes with the movable terminal cover, so that it is possible to detect an imperfect insertion of the metal terminal into the connector housing.

In the prior art connector of connecting metal terminals to a printed circuit board, however, since the terminal retainer is formed into a simple flat plate shape, whenever some metal terminals are not perfectly inserted into the connector housing, the terminal retainer is deformed along the longitudinal direction thereof. In particular, when the middle metal terminal is not perfectly inserted into the connector housing, since the both sides of the metal terminals are deformed into a convex shape (the middle portion projects upward) along the longitudinal direction thereof when the metal retainer is forcedly pushed toward the connector housing, there exists a problem in that the terminal cover can be moved erroneously from the terminal cover position to the terminal uncover position, thus causing an imperfect insertion of the metal terminals into the connector housing, that is, a malconnection between the metal terminals and the printed circuit board.

SUMMARY OF THE INVENTION

With these problems in mind, therefore, it is the object of the present invention to provide a connector for connecting metal terminals to a circuit board perfectly, which can securely inhibit the movement of the terminal cover from the terminal cover position to the terminal uncover position, when there exists some imperfectly-inserted metal terminals, while securely detecting the positions of the imperfectly-inserted metal terminals into the connector housing.

To achieve the above-mentioned object, the present invention provides a connector for connecting a plurality of metal terminals (25) to a circuit board (95), which comprises: a connector housing (27) formed with a plurality of metal terminal accommodate chambers (39) each for accommodating each metal terminal inserted into the connector housing, a part (47) of each metal terminal being exposed outside from the metal terminal accommodate chamber, for connection with the circuit board when engaged with the connector housing in parallel with the metal terminals; a terminal cover (31) slidably engaged with both ends of the connector housing for movement between a terminal cover position and a terminal uncover position; and a terminal retainer (33, 96, 107) engaged with the connector housing in a direction perpendicular to an insertion direction of the metal terminals, said terminal retainer capable of engaging with the connector housing in two positions a temporal engage position, at which the terminal retainer is disengaged from the metal terminals which prevents terminal cover movement to the terminal uncover position and a full engage position, at which the terminal retainer is engaged with the metal terminals for prevention of removal of the metal terminals from the connector housing which allows the terminal cover to move to the terminal uncover position, the terminal retainer including: a pair of engage side walls (78) engaged with the connector housing; a detect plate portion (79, 98, 111) formed between the engage side walls and having at least one flexible detect arm (87, 101, 103) extending in a retainer lateral direction from the terminal retainer and in parallel with the metal terminals; and at least one detect projection (89, 103, 115) formed integrally on a free end of the flexible detect arm, the detect projection being prevented from insertion into each of the terminal accommodate chambers by bend of the flexible detect arm due to contact with an imperfectly-inserted metal terminal at the full engage position of the terminal retainer, but inserted into each of the terminal accommodate chambers at the temporal engage position thereof without contact with a perfectly-inserted metal terminal.

Further, in the basic embodiment, the detect plate portion (98) includes: a base portion (85), and wherein a number of the flexible detect arms is the same as that of the terminal accommodate chambers extending from the base portion in the lateral direction of the terminal retainer in parallel with the metal terminals.

Further, in the first modification, the detect plate portion (98) includes: a single flexible detect arm (101) separated from the engage side walls by two side slits (99) extending from a base portion of the terminal retainer in the lateral direction of the terminal retainer in parallel with the metal terminals.

Further, in the second modification, the detect plate portion (98) includes: two single flexible detect arms (113) separated from the engage side walls by two side slits (109) and a middle slit (109) extending from a base portion of the terminal retainer in the lateral direction of the terminal retainer in parallel with the metal terminals.

Further, an elastic contact portion (47) formed near an end contact portion (29) of each of the metal terminals projects from each terminal accommodate chamber (39) through an opening formed in the connector housing in such a way as to be brought into contact with each of a plurality of terminal plates (97) formed in the circuit board (95) attached to a casing (93), on condition that the terminal cover (31) can be moved to the terminal uncover position when the connector is engaged with a connector engage portion (93*a*) of the casing (93).

Further, a retainer engage portion (45*a*) formed between a wire clamp portion (43) and an end contact portion (29) of each of the metal terminals is engaged with each of the detect projections (89, 101, 103) of the terminal retainer, only when the metal terminal is perfectly inserted into the terminal accommodate chamber of the connector housing and thereby the metal retainer is engaged with the connector housing at the full engage position.

Further, the connector housing (27) having:

a housing body (35) formed with the terminal accommodate chambers (39); a board connect portion (37) extending from the housing body and formed outside the terminal accommodate chambers, for accommodating the circuit board; a pair of side retainer support walls (71) formed on both sides of the housing body and each having a temporal engage projection (75) and a full engage projection (77); and a pair of side cover support walls (49) formed on both sides of the board connect portion (37) and each having a cover slide groove (51) and two cover lock grooves (55), respectively.

Further, the terminal cover (31) having: a terminal cover plate (57) for covering an upper side of the inserted metal terminals at the terminal cover position; two side slide portions (53) slidably engaged with the two cover slide grooves (51) formed on both sides of the connector housing, respectively; and three engage projections (67, 69) formed at both outer ends of the two side slide portions (53), respectively and selectively engaged with the two cover lock grooves (55) formed on both outer sides of the cover support walls of the connector housing, respectively between the terminal cover position and the terminal uncover position.

Further, the terminal retainer (33, 96, 107) having: two temporal engage locks (81) formed on both sides of the terminal retainer, respectively and engaged with the two temporal engage projections (75) formed on the side retainer support walls of the connector housing, respectively; and two full engage locks (83) formed on both sides of the terminal retainer, respectively and engaged with the two full engage projections (77) formed on the side retainer support walls of the connector housing, respectively.

As described above, in the connector for connecting a plurality of metal terminals to a circuit board according to the present invention, only when the metal terminals have been all inserted into the connector housing perfectly, the terminal retainer can be engaged with the connector housing at the full engage position. Under these conditions, the terminal retainer is engaged with the inserted metal terminals for prevention of removal of the metal terminals from the connector housing. In addition, since the terminal cover can be moved from the terminal cover position to the terminal uncover position, when the connector is engaged with the casing having a circuit board, it is possible to automatically move the terminal cover from the terminal cover position to the terminal uncover position, so that the metal terminals can be connected to the terminal plates of the circuit board securely.

On the other hand, when any of the metal terminals are not inserted into the connector housing perfectly, since the flexible detect arms of the terminal retainer are deformed outward, the terminal retainer cannot be engaged with the connector housing at the full engage position but kept at the temporal engage position. Therefore, the terminal cover will not be moved from the terminal cover position to the terminal uncover position. Therefore, even if the connector is engaged with the casing having a circuit board, it is impossible to engage the connector with the casing. In addition, when the terminal retainer is kept at the temporal engage position, since the flexible projection arms corresponding to the imperfectly-inserted metal terminals are deformed upward along the lateral direction in parallel to the metal terminal (not the longitudinal direction of the retainer as with the case of the prior art), it is possible to easily recognize the positions of the imperfectly-inserted metal terminals for re-insertion of the metal terminals perfectly in to the connector housing.

BRIEF DESCRIPTION OF THE DRAWINGS

FIG. 5(*b*) is a cross-sectional view showing the state where the metal terminal is not inserted into the connector housing perfectly, so that the terminal retainer is also not engaged with the metal terminal perfectly and thereby the terminal cover cannot be moved from the terminal cover position to the terminal uncover position abnormally;

FIG. 6(*b*) is a cross-sectional view showing the state where a terminal removing jig is inserted into the connector housing and the engage arm of the connector housing has been removed from the metal terminal, under the condition that the terminal retainer is not engaged with the metal terminal perfectly and thereby the terminal cover is located at the terminal cover position;

DETAILED DESCRIPTION OF THE EMBODIMENTS

The connector for connecting metal terminals to a circuit board and provided with a terminal cover and a terminal retainer according to the present invention will be described in detail hereinbelow with reference to the attached drawings.

(Basic Embodiment)

Figure 1:
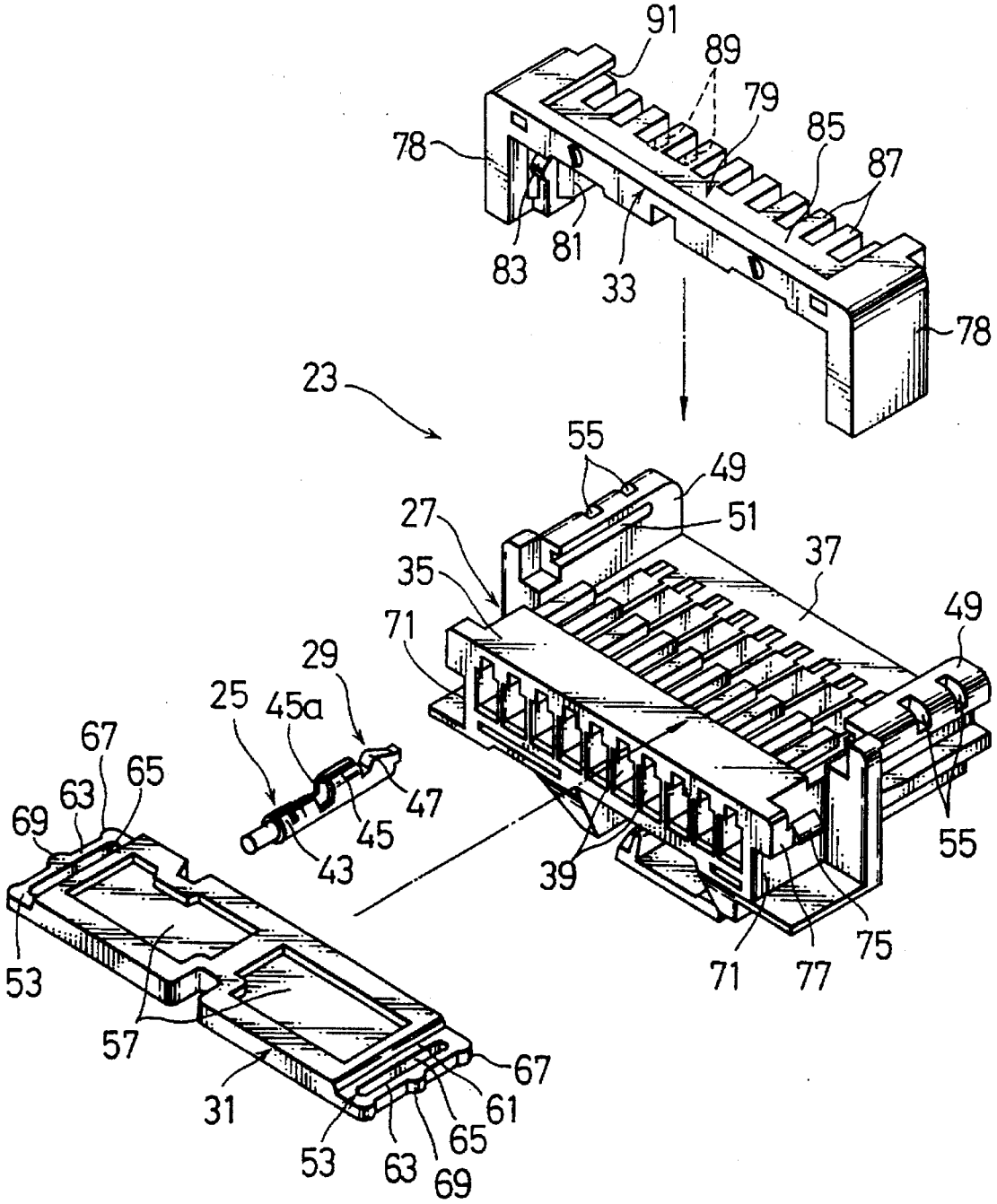
FIG. 1 is an exploded view showing a basic embodiment of the connector for connecting metal terminals to a circuit board according to the present invention.
Figure 2:
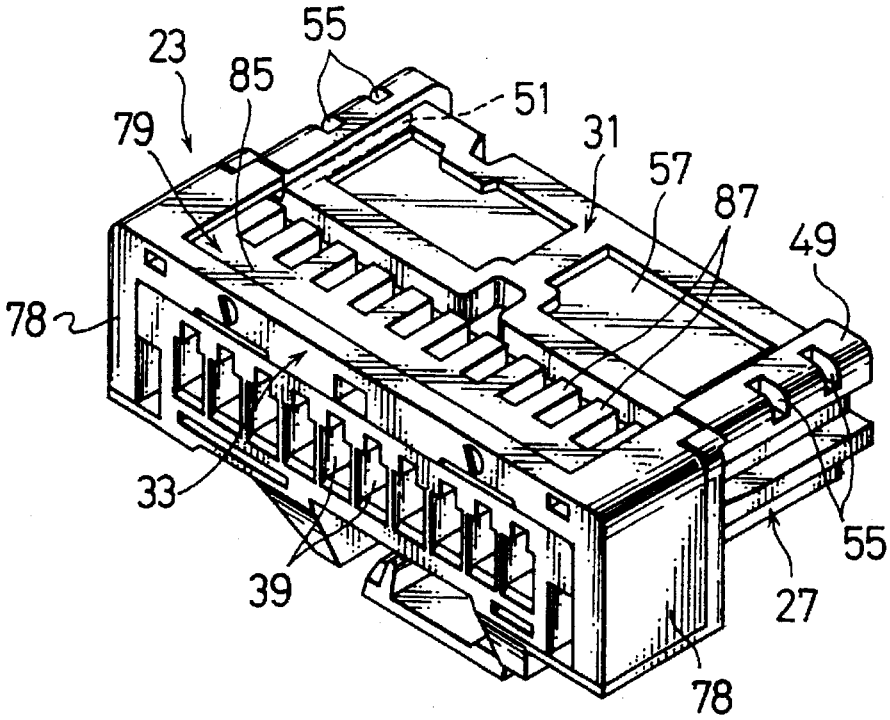
FIG. 2 is a perspective view showing the same basic embodiment of the connector according to the present invention under assembled condition.
Figure 3:
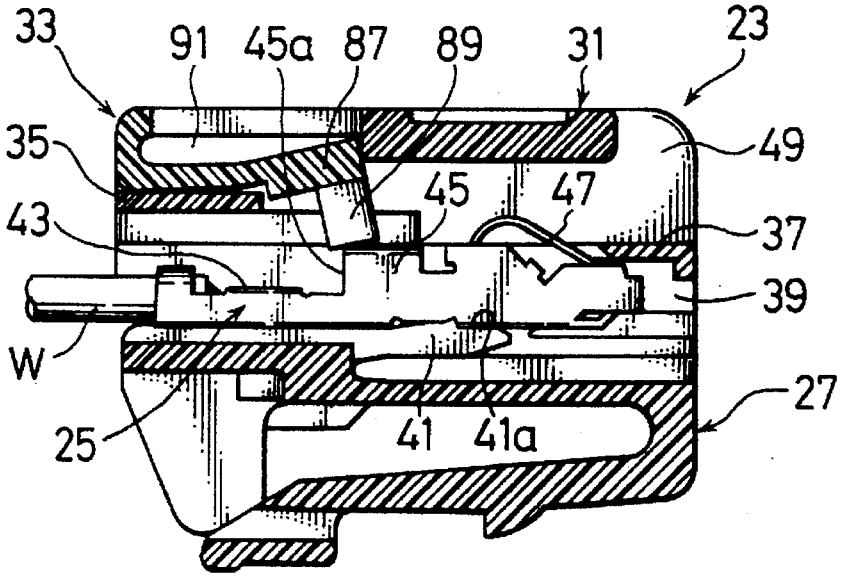
FIG. 3 is a cross-sectional view showing the same basic embodiment of the connector according to the present invention, in which the metal terminal is inserted into the connector housing imperfectly.
Figure 4:
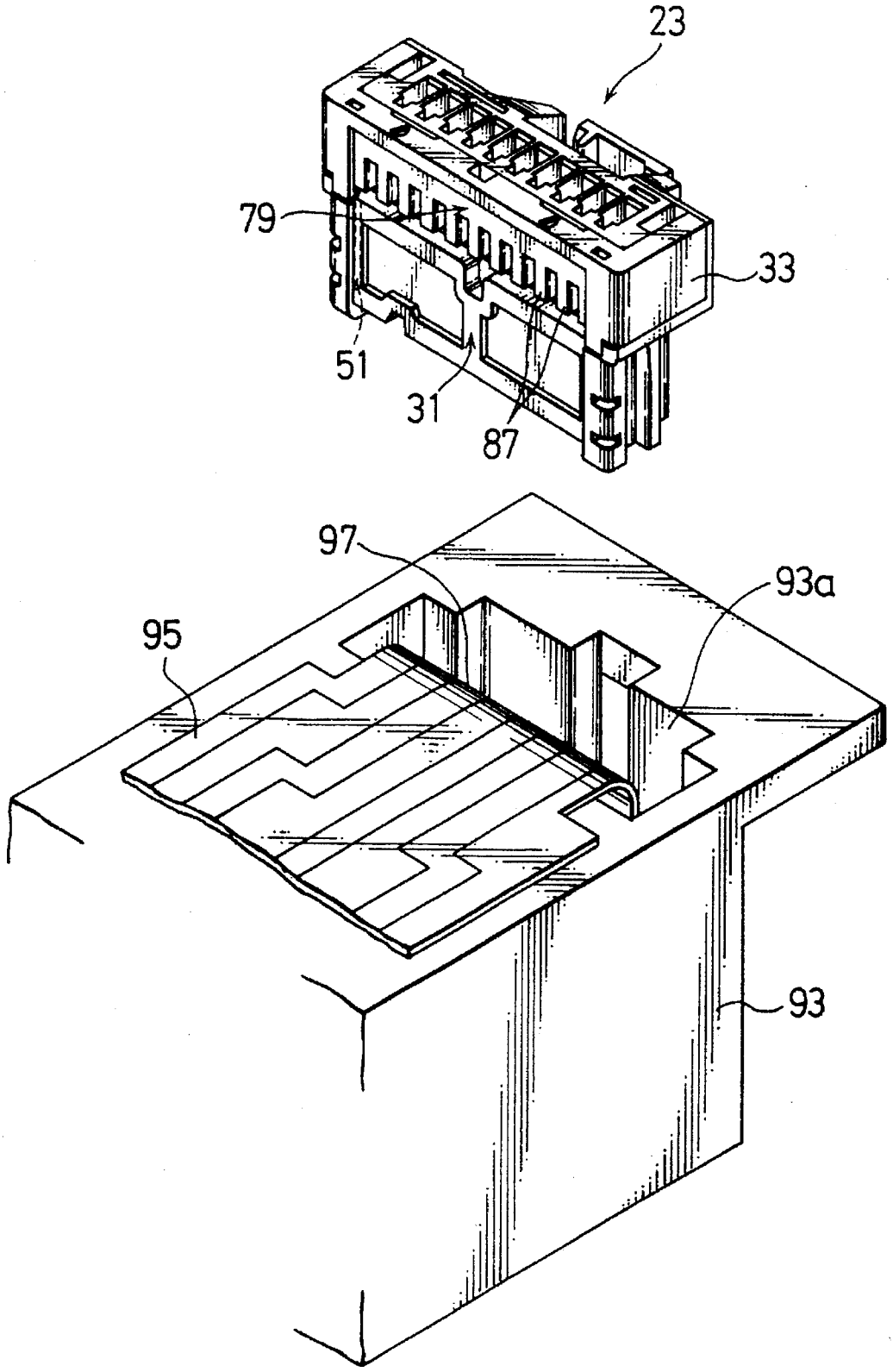
FIG. 4 is a perspective view showing the same embodiment of the connector according to the present invention, in which the connector and a casing having a circuit board to be connected to the metal terminals are both shown.

With reference to FIGS. 1 to 3, the connector 23 of this basic embodiment is roughly composed of a connector housing 27 for accommodating a plurality of metal terminals 25 (moved in the horizontal direction); a terminal retainer 33 (moved in the vertical direction) engaged with the rear ends of the metal terminals 25, for prevention of removal of the terminals 25 from the connector housing 27; and a terminal cover 31 (moved in the horizontal direction), for covering the metal terminals 25 for protection thereof, before the connector is engaged with a casing having a circuit board. In more detail, as shown in FIG. 4, the connector 23 (into which a plurality of the metal terminals 25 have been inserted perfectly) is further inserted into a connector engage portion 93*a* of a casing 93 (to which a circuit board 95 having terminal plates 97 is attached), so that the metal terminals 25 can be connected to the terminal plates 97 of the circuit board 95 via the connector 23.

Prior to the detailed description of the connector, in FIG. 1, the metal terminal 25 is formed with a clamp portion 43 clamped to wire W, a contact portion 29 connected to the terminal plate 97 of the circuit board 95, and an insertion detect portion 45 formed with an retainer engage portion 45*a* between the clamp portion 43 and the contact portion 29. When a detect projection 89 of the terminal retainer 33 1s engaged with this retainer engage portion 45*a*, the metal terminal 25 can be perfectly inserted into the connector housing 27 without removal therefrom. Further, the contact portion 29 is formed with an elastic contact piece 47 (shown in FIG. 3) elastically and electrically connected to the terminal plate 97 of the circuit board 95 within the connector housing 27.

Further, as shown in FIG. 1, the connector housing 27 is formed with a housing body 35 and a board connect portion 37 integrally. The housing body 35 is formed with a plurality of metal terminal accommodate chambers 39 extending toward the board connect portion 37. The terminal accommodate chamber 39 is partially opened on both the sides, as shown in FIG. 3. Therefore, when the metal terminal 25 has been inserted into the connector housing 27, the elastic contact piece 47 thereof can project through the inner (upward) opening so as to be connected to the terminal plate 97 of the circuit board 95. In addition, the terminal accommodate chamber 39 is formed with a flexible engage arm 41, which projects through the outer (downward) opening so that an end of a stepped engage portion 41*a* of the engage arm 41 can be engaged with an engage hole formed in the lower surface of the metal terminal 25, as shown in FIG. 3, for prevention of removal of the metal terminal 25 from the connector housing 27.

In FIG. 1, a pair of cover support walls 49 are formed on both sides of the board connect portion 37 of the connector housing 27. A slide grooves 51 is formed on the inner side surface of the cover support wall 49 along the terminal accommodate chamber 39, respectively. Therefore, two side slide portions 53 of the terminal cover 31 can be engaged with and slid along the two slide grooves 51 of the cover support walls 49 of the connector housing 27. Further, each of the cover support wall 49 is formed with two cover lock grooves 55 communicating with each slide groove 51 on the outer side thereof, so that the metal cover 31 can be moved and locked between the terminal cover position (on the right side in FIG. 3) and the terminal uncover position (on the left side in FIG. 3), respectively.

The metal cover 31 is composed of two flat cover portions 57 for covering the upper side of the board connect portion 37 of the connector housing 27, and the two slide portions 53 formed on both sides of the cover portions 53 so as to be engaged with and slidable along slide grooves 51 formed in the cover support walls 49 of the connector housing 27, as already explained. Further, each slide portion 53 is formed with a base portion 61 formed on the outer side of the flat cover portion 57, and a flexible plate portion 63 formed integral with the base portion 61. A through hole 65 is formed between the base portion 61 and the plate portion 63 to allow the plate portion 63 to be deformable inward or toward the base portion 61. On the outer side of each of the plate portion 63, three cover engage projections (composed of a middle projection 69 and two side projections 67) are formed. When these two cover engage projections 69 and 67 are selectively engaged with the two cover lock grooves 55 of each of the cover support walls 49 of the connector housing 27, the terminal cover 31 can be located at the terminal cover position (over the board connect portion 37) or at the terminal uncover position. In more detail, when the terminal cover 81 is pushed toward the right side in FIG. 1, two of these three cover engage projections 69 can be engaged with the two cover lock grooves 55 to locate the metal cover 81 at the terminal cover position. On the other hand, when the terminal cover 81 is pushed toward the left side in FIG. 1, two of these three cover engage projections 69 can be disengaged from the two cover lock grooves 55 to locate the metal cover 81 at the terminal uncover position.

Further, the housing body 85 is formed with two terminal retainer support walls 71 on both sides thereof. Each of the two retainer support walls 71 is formed with a temporal engage projection 75 at the middle portion thereof and with a full engage projection 77 on the open side (the metal terminal insertion (the left) side in FIG. 1), respectively, so that the terminal retainer 88 can be supported at the temporal engage position and the full engage position, respectively.

The terminal retainer 88 is formed into a U-shape, which is composed of two engage side walls 78 engaged with the retainer support walls 71, respectively and a detect plate portion 79 connecting the two engage side walls 78. Further, a temporal engage lock 81 (engaged with the temporal engage projection 75 of the connector housing 27) and a full engage lock 88 (engaged with the full engage projection 77) are formed on the two opposing inner sides of the two engage side walls 78, respectively. Therefore, when the temporal engage projection 75 of the connector housing 27 is engaged with the temporal engage lock 81 of the retainer 33, the retainer 33 is engaged with the connector housing 27 at the temporal engage position. On the other hand, when the full engage projection 77 of the connector housing 27 is engaged with the full engage lock 83 of the retainer 33, the retainer 33 is engaged with the connector housing 27 at the full engage position.

Further, the detect plate portion 79 is composed of a base portion 85, a plurality of flexible detect arms 87 each formed extending from the base portion 85 in the horizontal direction (in the lateral direction of the terminal retainer 33) in FIG. 1 along the terminal accommodate chambers 39, respectively, and a plurality of detect projections 89 each formed projecting in the vertical direction from each free end of the flexible detect arm 87. Further, a slide groove 91 is formed on both side ends of the terminal retainer 33 between the detect plate portion 79 and each of the engage side walls 78, respectively, along which the terminal cover 31 can be moved from the terminal cover position to the terminal uncover position.

Figure 5A:
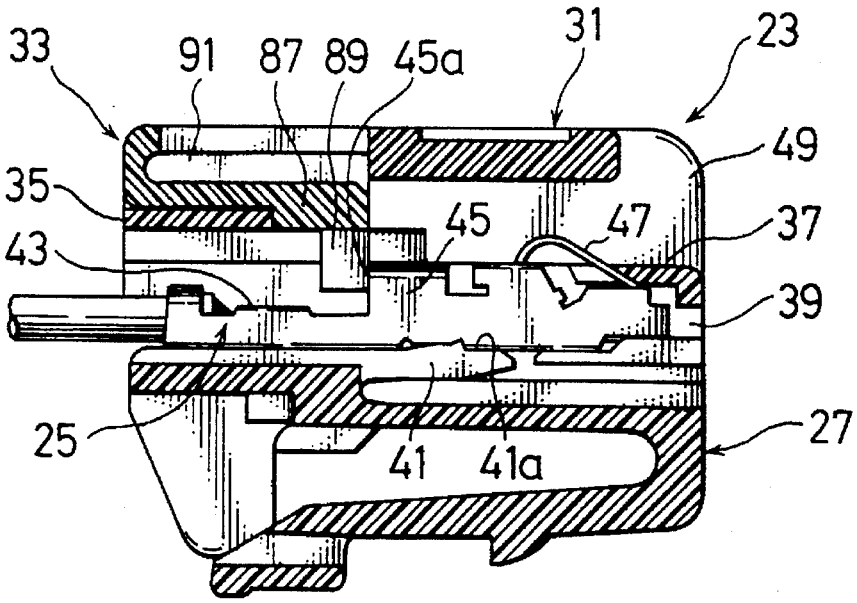
FIG. 5(*a*) is a cross-sectional view showing the state where the metal terminal is inserted into the connector housing perfectly, so that the terminal retainer is also engaged with the metal terminal perfectly and thereby the terminal cover can be moved between the terminal cover position and the terminal uncover position normally.
Figure 5B:
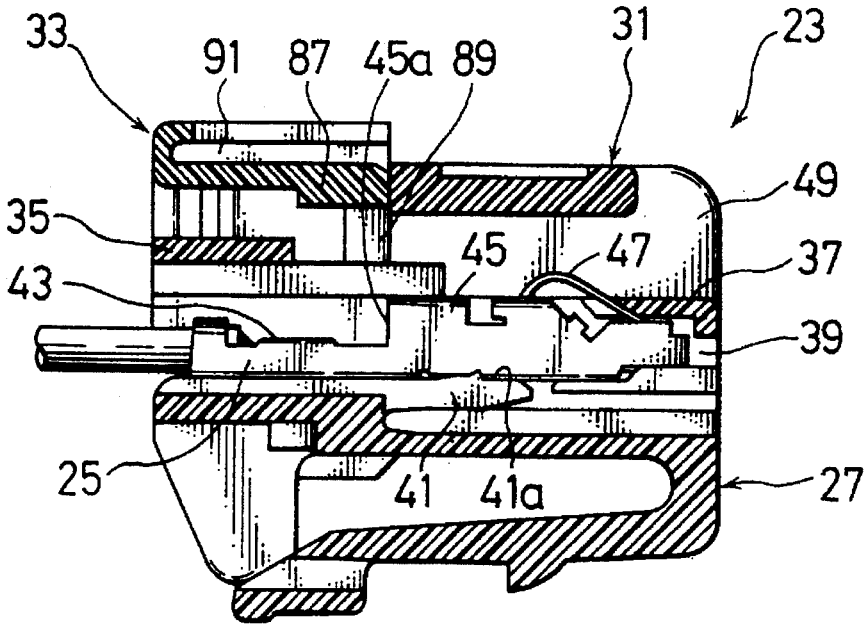

Under the condition that the terminal retainer 33 is engaged with the connector housing 27 at the temporal engage position , as shown in FIG. 5(*b*), since the detect arm 87 of the detect plate portion 79 closes the two slide grooves 51, the terminal cover 31 cannot be moved leftward to the terminal uncover position. At the same time, since the detect projection 89 of the terminal retainer 33 is located out of the terminal accommodate chambers 39; that is, since the detect projection 89 is disengaged from the insertion detect portion 45 of the metal terminals 25, the metal terminal 25 can be removed from the connector housing 27.

On the other hand, under the condition that the terminal retainer 33 is engaged with the connector housing 27 at the full engage position, as shown in FIG. 5(*a*), since the detect arm 87 of the detect plate portion 79 opens the two slide grooves 91 and thereby the slide grooves 91 communicate with the slide grooves 51, the terminal cover 31 can be moved to the leftward to the terminal uncover position. At the same time, since the detect projection 89 of the terminal retainer 33 is inserted into the terminal accommodate chamber 39 and thereby engaged with the insertion detect portions 45 of the metal terminals 25, the metal terminal 25 cannot be removed from the connector housing 27.

Under these conditions, the metal terminals 25 can be prevented doubly from removal from the connector housing 27 by the engage arms 41 of the connector housing 27 and the detect projections 89 of the terminal retainer 33. Further, when the metal terminals 25 are not inserted into the terminal accommodate chambers 39 of the connector housing 27 perfectly, even if the terminal retainer 33 is pushed toward the connector housing 27 forcibly, since the detect projections 89 of the terminal retainer 33 are brought into contact with the insertion detect portions 45 of the metal terminals 25, the detect arms 87 of the metal retainer 33 deform upward (toward the slide grooves 91), so that the terminal cover 31 cannot be moved to the terminal uncover position. At the same time, it is possible to recognize which detect arms 87 of the terminal retainer 33 are deformed upward and thereby which metal terminals 25 are not perfectly inserted into the connector housing 27.

The assembly procedure of the connector 23 will be explained hereinbelow.

First, the terminal cover 31 is assembled with the connector housing 27 by engaging the slide portions 53 of the terminal cover 31 with the two slide grooves 51 of the connector housing 27 in the horizontal direction in FIG. 1 or 3. Secondly, the terminal retainer 33 is assembled with the connector housing 27 by attaching the two engage side walls 78 of the terminal retainer 33 with the retainer support walls 71 of the connector housing 27 in the vertical direction in FIG. 1 or 3. In this assembly process, the temporal engage locks 81 of the terminal retainer 33 are engaged with the temporal engage projections 75 of the connector housing 27 to temporarily engage the terminal retainer 33 with the connector housing 27. Under these conditions, the metal terminals 25 are inserted into the respective terminal accommodate chambers 39 in the horizontal direction in FIG. 1 or 3. Whenever the metal terminal 25 is inserted, the stepped engage portion 41*a* (shown in FIG. 3) of the flexible engage portion 41 of the connector housing is engaged with an engage hole formed in the metal terminal 25. After all the metal terminals 25 have been perfectly inserted into the connector housing 27, the detect plate portion 79 of the terminal retainer 33 is further pushed vertically to the full (perfect) engage position. Under these perfect engage position, the full engage locks 83 of the terminal retainer 33 are engaged with the full engage projections 77 of the connector housing 27 to perfectly engage the terminal retainer 33 with the connector housing 27. Further, the detect projections 89 of the terminal retainer 33 are engaged with the retainer engage portions 45*a* of the insertion detect portions 45 of the metal terminals 25, so that the metal terminals 25 will not be removed from the terminal accommodate chambers 39 of the connector housing 27.

In this case, when some metal terminals 25 are half inserted into the terminal accommodate chambers 39 imperfectly, as shown in FIG. 3, since the flexible engage portions 41 of the connector housing 25 are not engaged with the engage holes of the metal terminals 25, the detect projection portions 89 of the terminal retainer 33 are brought into contact with the upper surfaces of (disengaged from) the insertion detect portions 45 of the metal terminals 25, so that the detect arms 87 are bent upward. As a result, since the detect arms 87 close the cover grooves 51, it is impossible to move the metal cover 31 from the terminal cover position to the terminal uncover position.

Under these conditions, as shown in FIG. 4, if the board connect portion 37 of the connector housing 27 is engaged with the connector engage portion 93*a* of the casing 93, since the terminal cover 31 will not be moved due to contact with the detect arms 87 of the terminal retainer 33 and thereby the board connect portion 37 is kept closed by the terminal cover 31, it is impossible to insert the connector 23 into the casing 93, so that the imperfect (half) insertion of the metal terminals 25 into the connector housing 27 can be detected.

In addition, the metal terminals 25 inserted imperfectly can be detected by the visual inspection by finding the upward bent detect arms 87. Therefore, it is possible to easily insert again the imperfectly-inserted metal terminals perfectly into the connector housing 27. After the metal terminals 25 have been all inserted into the terminal accommodate chambers 39 perfectly, the board connect portion 37 of the connector housing 27 is engaged with the connector engage portion 93*a* of the casing 93. In this case, since the terminal cover 31 can be then moved to the terminal uncover position and thereby the board connect portion 37 can be opened in the casing 93, the elastic contact pieces 47 of the metal terminals 25 can be brought into contact with the terminal plates 97 of the circuit board 95, with the result that it is possible to connect the metal terminals 25 with the terminal plates 97 of the circuit board 95 perfectly, while preventing the removal of the metal terminals from the connector housing 27 by the double lock structure (by the flexible engage arms 41 of the housing 27 and the detect projections 89 of the retainer 33).

Figure 6A:
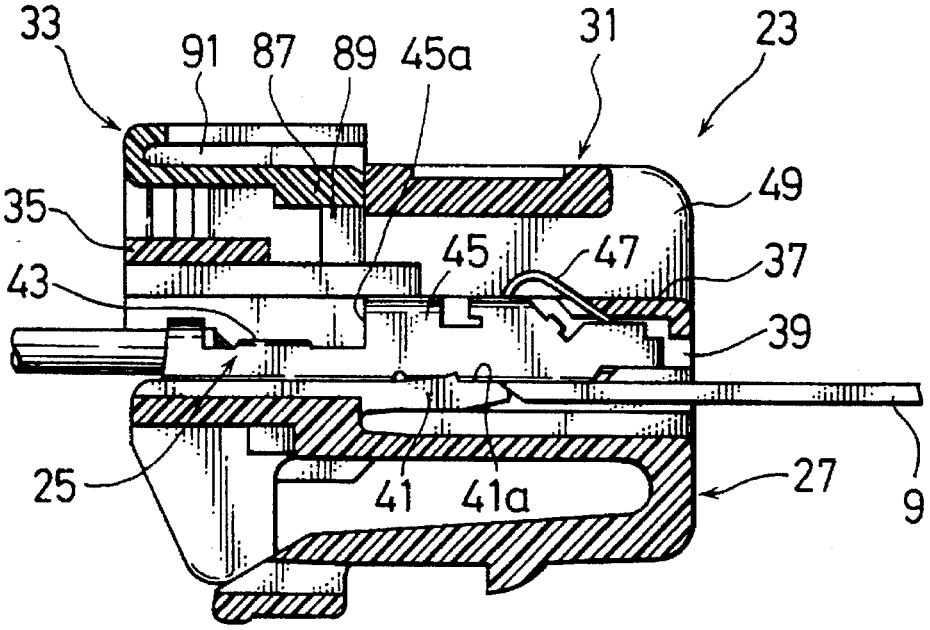
FIG. 6(*a*) is a cross-sectional view showing the state where a terminal removing jig is inserted into the connector housing to disengage the engage arm of the connector housing from the metal terminal, under the condition that the terminal retainer is not engaged with the metal terminal perfectly and thereby the terminal cover is located at the terminal cover position.
Figure 6B:
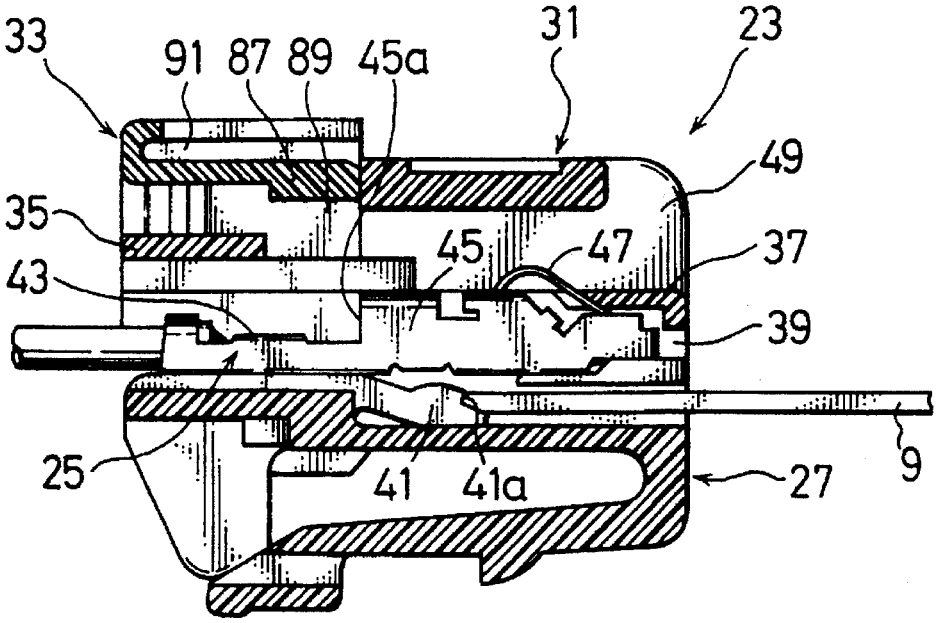

Under the assembled conditions that the metal terminals 25 are double locked by the connector housing 27 and the terminal retainer 33 as shown in FIG. 5(*a*), when the metal terminals 25 are required to be removed from the connector housing 27, first the metal retainer 33 is moved from the full engage position to the temporal engage position, as shown in FIG. 5(*b*), to disengage the detect projections 89 of the terminal retainer 33 from the retainer engage portions 45*a* of the metal terminals 25. Under these conditions, as shown in FIG. 6(*a*), a long jig 9 is inserted into the terminal accommodate chambers 39 from the right side in FIG. 6(*a*), to forcibly deform the flexible engage arms 41 of the connector housing 27 as shown in FIG. 6(*b*), so that the metal terminals 25 can be releases from the connector housing 27. Under these conditions, the metal terminals 25 can be removed from the connector housing 27 freely.

In the basic embodiment of the connector according to the present invention, since the terminal retainer 33 is formed with the detect plate portion 79 composed of the detect arms 87 extending from the detect plate portion 79 in the lateral direction there of in parallel to the metal terminals 25, and the detect projections 89 formed at the ends of the detect arms 87 so as to be inserted into each of the terminal accommodate chambers 39. When the metal terminals 25 are half inserted into the terminal accommodate chambers 39 at the temporal engage position of the terminal retainer 33, since the detect arms 87 can be bent upward in the lateral direction of the metal retainer 33, it is possible to securely detect the imperfect insertion of the metal terminals 25 into the connector housing 27. In addition, when the metal terminals 25 are not all inserted into the connector housing 27 perfectly, since only the detect arms 87 just over the imperfectly-inserted metal terminals 25 are deformed upward, it is possible to easily detect the metal terminals 25 inserted imperfectly, while preventing the terminal cover 31 from being shifted from the terminal cover position to the metal uncover position, that is, the connector 23 from being engaged with the casing 93 in which the circuit board 95 is attached.

(First Modification)

Figure 7:
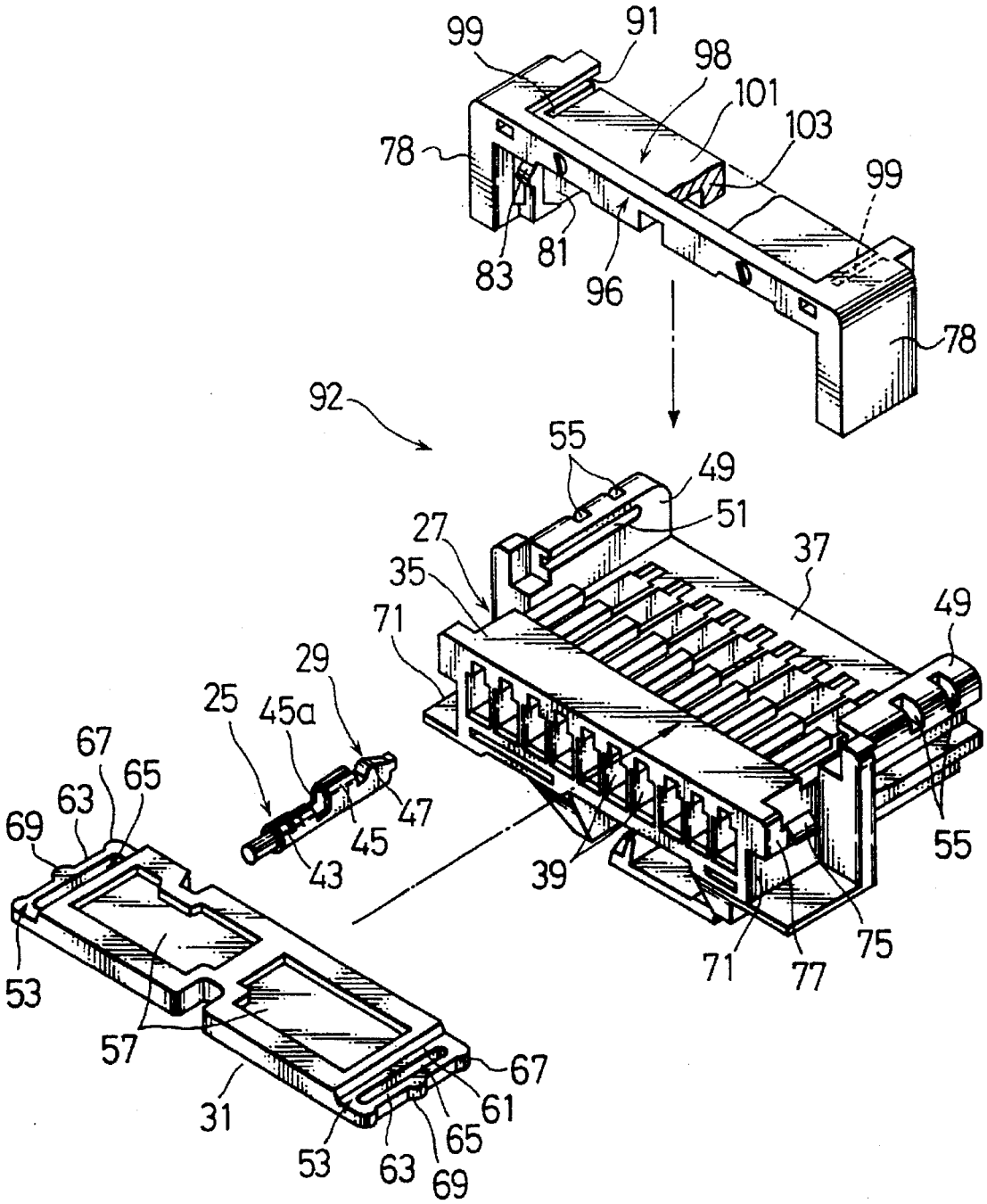
FIG. 7 is an exploded view showing a first modification of the connector for connecting metal terminals to a circuit board according to the present invention.
Figure 8:
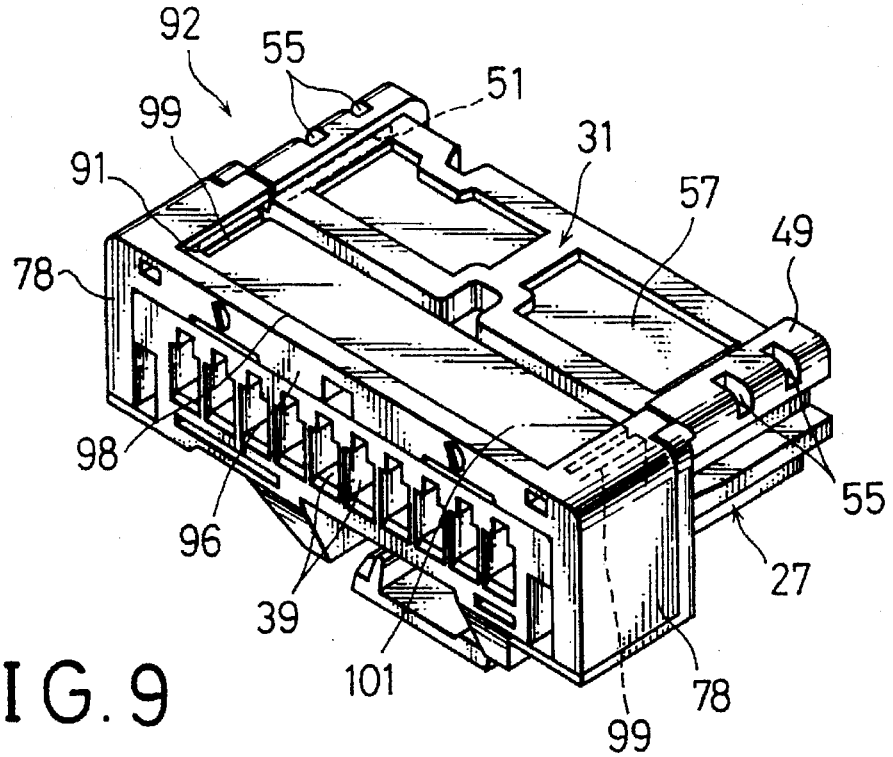
FIG. 8 is a perspective view showing the first modification of the connector according to the present invention under assembled condition.
Figure 9:
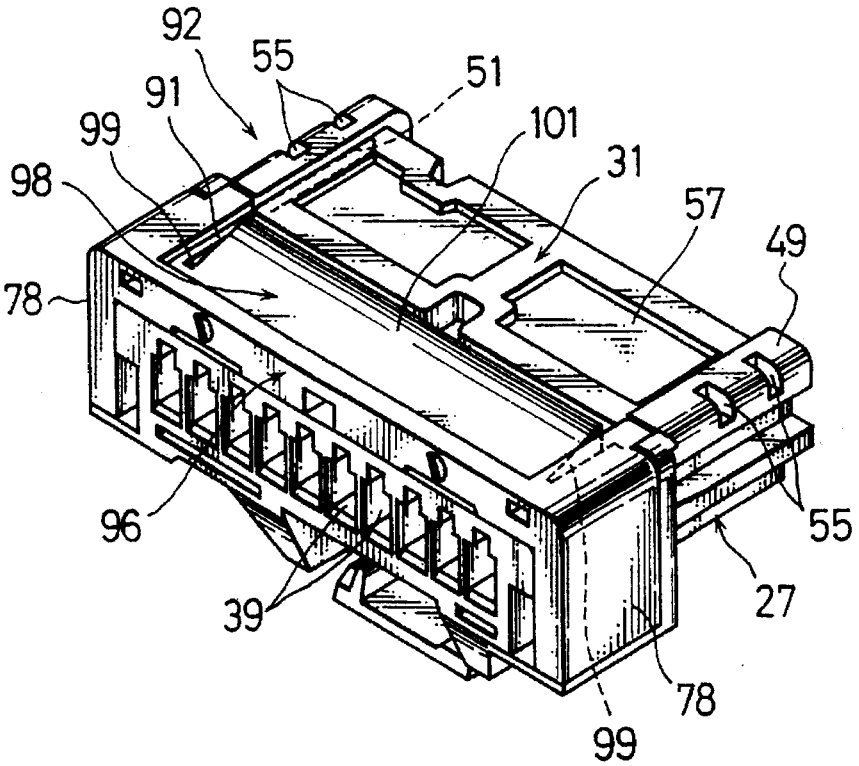
FIG. 9 is a cross-sectional view showing the same first modification of the connector according to the present invention, in which the metal terminal is inserted into the connector housing imperfectly.

With reference to FIGS. 7 to 9, a first modification of the connector according to the present invention will be described hereinbelow. This modification is different from the basic embodiment shown in FIGS. 1 to 6 in only the structure or shape of the terminal retainer 96 from that 33 of the basic embodiment. In FIGS. 7 to 9, the same reference numerals have been retained for the similar parts or elements which have the same functions as with the case of the first embodiment.

As shown in FIGS. 7 and 8, the terminal retainer 96 of this modification is formed into a U-shape, which is composed of two engage side walls 78 engaged with the two retainer support walls 71, respectively, and a detect plate portion 98 formed so as to connect the two engage side walls 78.

Further, a temporal engage lock 81 (engaged with the temporal engage projection 75 of the connector housing 27) and a full engage lock 83 (engaged with the full engage projection 77) are both formed on the two opposing inner sides of the two engage side walls 78, respectively. Therefore, when the temporal engage projections 75 of the connector housing 27 are engaged with the temporal engage locks 81 of the retainer 33, the terminal retainer 96 is engaged with the connector housing 27 at the temporal engage position. On the other hand, when the full engage projections 77 of the connector housing 27 are engaged with the full engage locks 83 of the terminal retainer 98, the retainer 96 is engaged with the connector housing 27 at the full engage position.

Further, the detect plate portion 98 is formed with two side slits 99 near and along the slide grooves 91, respectively, in such a way the long flat portion can extend in the lateral direction of the terminal retainer 96 (in parallel to the metal terminals 25) as the flexible detect arm 101. Further, a plurality of detect projections 103 are formed projecting inward (downward in the vertical direction in FIG. 7) from the free end of the flexible detect arm 98 at regular intervals so as to be engaged with the retainer engage portion 45*a* of the metal terminals 25 inserted into the terminal accommodate chambers 39 of the connector housing 27.

In the same way as with the case of the basic embodiment, under the condition that the terminal retainer 96 is engaged with the connector housing 27 at the temporal engage position, since the detect arm 101 of the detect plate portion 98 closes the two slide grooves 51, the terminal cover 31 cannot be moved leftward to the terminal uncover position. At the same time, since the detect projections 103 of the terminal retainer 96 are located out of the terminal accommodate chambers 39; that is, since the metal terminals 25 are not engaged with the detect projections 103, the metal terminals 25 can be removed from the connector housing 27.

On the other hand, under the condition that the terminal retainer 96 is engaged with the connector housing 27 at the full engage position, since the detect arm 101 of the detect plate portion 98 opens the two slide grooves 51 and thereby the slide grooves 51 communicate with the slide grooves 91, the terminal cover 31 can be moved leftward to the terminal uncover position. At the same time, since the detect projections 103 of the retainer 96 are inserted into the terminal accommodate chambers 39; that is, since the detect projections 103 are engaged with the insertion detect portions 45 of the metal terminals 25, the metal terminal 25 cannot be removed from the connector housing 27.

Under these conditions, the metal terminals 25 can be prevented doubly from removal from the connector housing 27 by the flexible engage arms 41 of the connector housing 27 and the detect projections 103 of the terminal retainer 33. Further, when the metal terminals 25 are not inserted into the terminal accommodate chambers 39 of the connector housing 27 perfectly, even if the terminal retainer 96 is pushed toward the connector housing 27 forcibly, since the detect projections 103 of the terminal retainer 96 are brought into contact with the insertion detect portions 45 of the metal terminals 25, the detect arm 101 of the metal retainer 96 deforms outward or upward all over the length thereof, as shown in FIG. 9, so that the terminal cover 31 cannot be moved to the terminal uncover position. As a result, it is possible to recognize that the detect arm 101 of the terminal retainer 96 is deformed and thereby the metal terminals 25 are not perfectly inserted into the connector housing 27.

In this first modification, since the width dimension of the detect arm 101 (in the longitudinal direction in FIG. 7) is wider than that 87 of the basic embodiment, when the metal terminals 25 are inserted imperfectly into the connector housing 27, the terminal cover 31 can be brought into contact with the detect arm 101 at a wider area, so that it is possible to more securely prevent the terminal cover 31 from being moved from the terminal cover position to the terminal uncover position.

(Second Modification)

Figure 10:
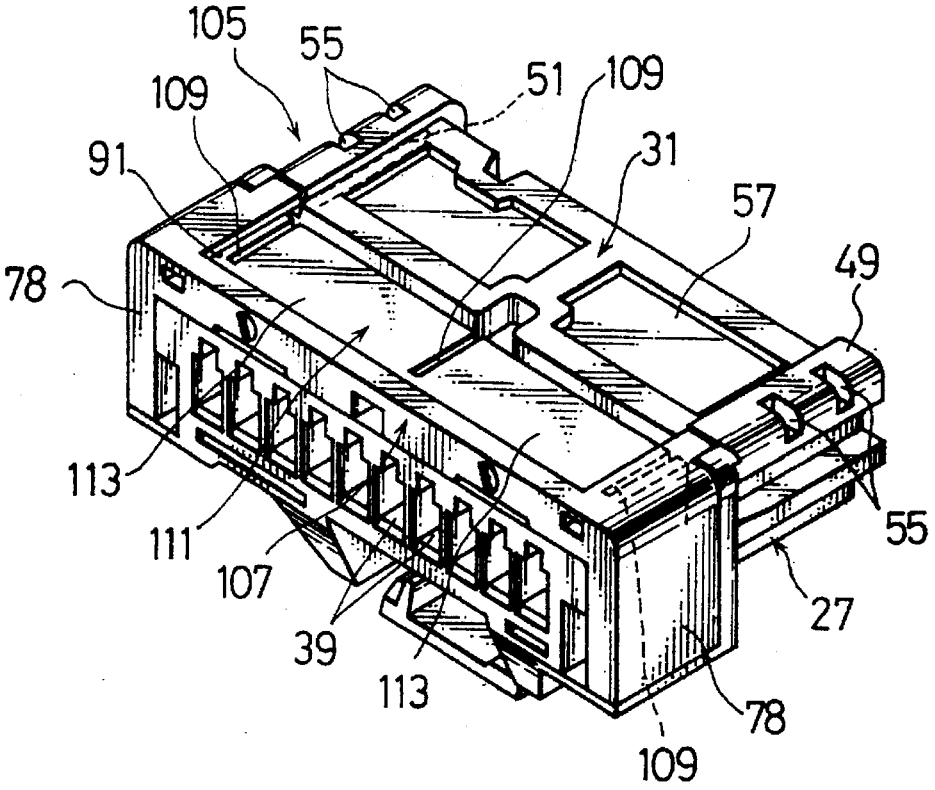
FIG. 10 is a perspective view showing a second modification of the connector according to the present invention under assembled condition.
Figure 11:
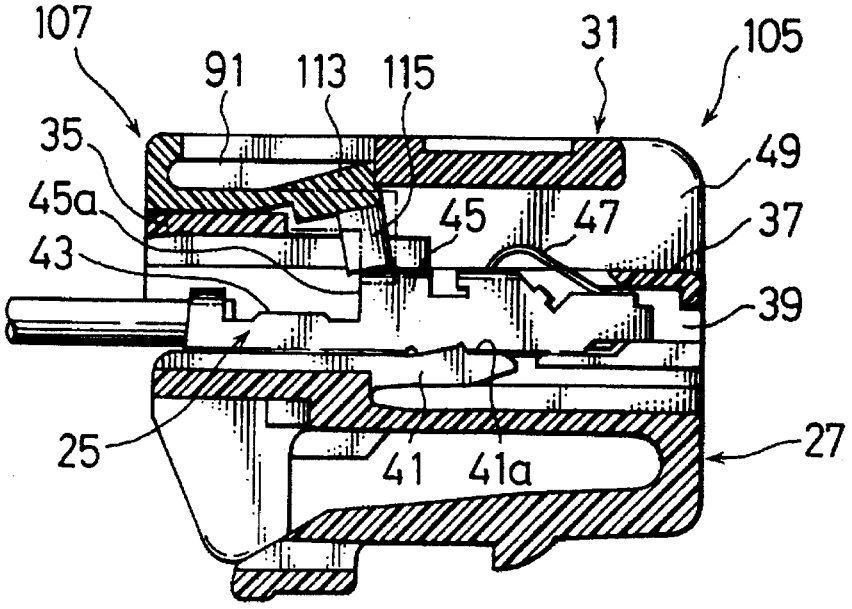
FIG. 11 is a cross-sectional view showing the same second modification of the connector according to the present invention, in which the metal terminal is inserted into the connector housing imperfectly.

With reference to FIGS. 10 to 11, a second modification of the connector according to the present invention will be described hereinbelow. This modification is different from the first modification shown in FIGS. 7 to 9 in only the structure or shape of the terminal retainer 107 from that 96 of the first modification. In FIGS. 10 to 11, the same reference numerals have been retained for the similar parts or elements which have the same functions as with the case of the first embodiment.

As shown in FIGS. 10 and 11, the terminal retainer 107 of this modification is formed into a U-shaped, which is composed of two engage side walls 78 engaged with the retainer support walls 71 of the connector housing 27, respectively, and a detect plate portion 111 formed so as to connect the two engage side walls 78. Further, the detect plate portion 111 is formed with three side slits 111 near and along the slide grooves 91 and further at the middle portion thereof, respectively, in such a way two flat portions can be deformed as two flexible detect arm 113. Further, a plurality of detect projections 115 are formed projecting inward (downward in the vertical direction in FIG. 11) from the free ends of the two flexible detect arms 113 at regular intervals so as to be engaged with the insertion detect portion 45 of the metal terminals 25 inserted into the terminal accommodate chambers 39 of the connector housing 27.

In this second modification, since the middle slit 109 is additionally formed between the two detect arms 113, it is possible to more securely deform the two detect arms 113 upward when the metal terminals 25 are inserted into the connector housing 27 imperfectly.

As described above, in the connector for connecting a plurality of metal terminals to a circuit board according to the present invention, only when the metal terminals have been all inserted into the connector housing perfectly, the terminal retainer can be engaged with the connector housing at the full engage position. Under these conditions, the terminal retainer is engaged with the inserted metal terminals for prevention of removal of the metal terminals from the connector housing. In addition, since the terminal cover can be moved from the terminal cover position to the terminal uncover position, when the connector is engaged with the casing having a circuit board, it is possible to automatically move the terminal cover from the terminal cover position to the terminal uncover position, so that the metal terminals can be connected to the terminal plates of the circuit board securely.

On the other hand, when any of the metal terminals are not inserted into the connector housing perfectly, since the flexible detect arms of the terminal retainer are deformed outward, the terminal retainer cannot be engaged with the connector housing at the full engage position but kept at the temporal engage position. Therefore, the terminal cover will not be moved from the terminal cover position to the terminal uncover position. Therefore, even if the connector is engaged with the casing having a circuit board, it is impossible to engage the connector with the casing. In addition, when the terminal retainer is kept at the temporal engage position, since the flexible projection arms corresponding to the imperfectly-inserted metal terminals are deformed upward along the lateral direction in parallel to the metal terminal (not the longitudinal direction of the retainer as with the case of the prior art), it is possible to easily recognize the positions of the imperfectly-inserted metal terminals for re-insertion of the metal terminals perfectly in to the connector housing.

What is claimed is:

1. A connector for connecting a plurality of metal terminals to a circuit board, which comprises:

a connector housing formed with a plurality of metal terminal accommodate chambers each for accommodating a metal terminal inserted into the connector housing, a part of each metal terminal being exposed outside from the metal terminal accommodate chamber, for connection with the circuit board when engaged with the connector housing in parallel with the metal terminals;

a terminal cover slidably engaged with both ends of the connector housing for movement between a terminal cover position and a terminal uncover position; and a terminal retainer engaged with the connector housing in a direction perpendicular to an insertion direction of the metal terminals, said terminal retainer capable of engaging with the connector housing in two positions, a temporal engage position, at which the terminal retainer is disengaged from the metal terminals which prevents terminal cover movement to the terminal uncover position and a full engage position, at which the terminal retainer is engaged with the metal terminals for prevention of removal of the metal terminals from the connector housing which allows the terminal cover to move to the terminal uncover position, the terminal retainer including:

a pair of engage side walls engaged with the connector housing;

a detect plate portion formed between the engage side walls and having at least one flexible detect arm extending in a retainer lateral direction from the terminal retainer and in parallel with the metal terminals; and at least one detect projection formed integrally on a free end of the flexible detect arm the detect projection being prevented from insertion into the terminal accommodate chamber by bend of the flexible detect arm due to contact with an imperfectly-inserted metal terminal at the full engage position of the terminal retainer, but inserted into each of the terminal accommodate chambers at the temporal engage position thereof without contact with a perfectly-inserted metal terminal.

2. The connector for connecting a plurality of metal terminals to a circuit board of claim 1, wherein the detect plate portion further includes:

a base portion and wherein a number of the flexible detect arms is the same as that of the terminal accommodate chambers extending from the base portion in the lateral direction of the terminal retainer in parallel with the metal terminals.

3. The connector for connecting a plurality of metal terminals to a circuit board of claim 1, wherein the detect plate portion includes:

a single flexible detect arm separated from the engage side walls by two side slits extending from a base portion of the terminal retainer in the lateral direction of the terminal retainer in parallel with the metal terminals.

4. The connector for connecting a plurality of metal terminals to a circuit board of claim 1, wherein the detect plate portion includes:

two single flexible detect arms separated from the engage side walls by two side slits and a middle slit extending from a base portion of the terminal retainer in the lateral direction of the terminal retainer in parallel with the metal terminals.

5. The connector for connecting a plurality of metal terminals to a circuit board of claim 1, wherein an elastic contact portion formed near an end contact portion of each of the metal terminals projects from each terminal accommodate chamber through an opening formed in the connector housing in such a way as to be brought into contact with each of a plurality of terminal plates formed in the circuit board attached to a casing, on condition that the terminal cover can be moved to the terminal uncover position when the connector is engaged with a connector engage portion of the casing.

6. The connector for connecting a plurality of metal terminals to a circuit board of claim 1, wherein a retainer engage portion formed between a wire clamp portion and an end contact portion of each of the metal terminals is engaged with each of the detect projections of the terminal retainer, only when the metal terminal is perfectly inserted into the terminal accommodate chamber of the connector housing and thereby the metal retainer is engaged with the connector housing at the full engage position.

7. The connector for connecting a plurality of metal terminals to a circuit board of claim 1, wherein the connector housing having:

a housing body formed with the terminal accommodate chambers;

a board connect portion extending from the housing body and formed outside the terminal accommodate chambers, for accommodating the circuit board;

a pair of side retainer support walls formed on both sides of the housing body and each having a temporal engage projection and a full engage projection; and a pair of side cover support walls formed on both sides of the board connect portion and each having a cover slide groove and two cover lock grooves, respectively.

8. The connector for connecting a plurality of metal terminals to a circuit board of claim 7, wherein the terminal cover having:

a terminal cover plate for covering an upper side of the inserted metal terminals at the terminal cover position;

two side slide portions slidably engaged with the two cover slide grooves formed on both sides of the connector housing, respectively; and three engage projections formed at both outer ends of the two side slide portions, respectively and selectively engaged with the two cover lock grooves formed on both outer sides of the cover support walls of the connector housing, respectively between the terminal cover position and the terminal uncover position.

9. The connector for connecting a plurality of metal terminals to a circuit board of claim 7, wherein the terminal retainer having:

two temporal engage locks formed on both sides of the terminal retainer, respectively and engaged with the two temporal engage projections formed on the side retainer support walls of the connector housing, respectively; and two full engage locks formed on both sides of the terminal retainer, respectively and engaged with the two full engage projections formed on the side retainer support walls of the connector housing, respectively.

* * * * *